US009502834B2

(12) United States Patent
Hashimoto

(10) Patent No.: US 9,502,834 B2
(45) Date of Patent: Nov. 22, 2016

(54) COAXIAL-TYPE ELECTRIC CONNECTOR

(71) Applicant: DAI-ICHI SEIKO CO., LTD., Kyoto-shi (JP)

(72) Inventor: Yoichi Hashimoto, Tokyo (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 14/993,284

(22) Filed: Jan. 12, 2016

(65) Prior Publication Data

US 2016/0218471 A1 Jul. 28, 2016

(30) Foreign Application Priority Data

Jan. 28, 2015 (JP) ..... 2015-013884
Dec. 11, 2015 (JP) ..... 2015-242582

(51) Int. Cl.
*H01R 12/00* (2006.01)
*H01R 24/44* (2011.01)
*H01R 101/00* (2006.01)

(52) U.S. Cl.
CPC ..... *H01R 24/44* (2013.01); *H01R 2101/00* (2013.01)

(58) Field of Classification Search
CPC ..... H01R 24/46; H01R 24/38; H01R 9/05
USPC ..... 439/63, 581–584
See application file for complete search history.

(56) References Cited

U.S. PATENT DOCUMENTS 8,172,613 B1 * 5/2012 Chen ..... H01R 9/0518 439/582
9,184,535 B2 * 11/2015 Tsuchida ..... H01R 13/62
2002/0055281 A1 * 5/2002 Ko ..... H01R 9/0518 439/63
2002/0187660 A1 * 12/2002 Obayashi ..... H01R 9/0518 439/63
2003/0190824 A1 * 10/2003 Ko ..... H01R 9/0518 439/63
2006/0141811 A1 * 6/2006 Shichida ..... H01R 24/50 439/63
2008/0038940 A1 * 2/2008 Chen ..... H01R 9/0518 439/63
2010/0227481 A1 * 9/2010 Liao ..... H01R 24/46 439/63
2012/0164880 A1 * 6/2012 Chiu ..... H01R 24/40 439/582
2013/0149897 A1 * 6/2013 Takano ..... H01R 12/718 439/582

(Continued)

FOREIGN PATENT DOCUMENTS

CN EP 2568536 A4 * 1/2014 ..... H01R 9/0524
JP 2002-324636 11/2002
JP 2005-183214 7/2005

(Continued)

*Primary Examiner* — Tho D Ta
*Assistant Examiner* — Thang Nguyen
(74) *Attorney, Agent, or Firm* — Oblon, McClelland, Maier & Neustadt, L.L.P.

(57) ABSTRACT

Good signal transmission characteristics can be stably obtained by a simple configuration. A void portion formed by inner wall surfaces of a groove disposed so as to face a wire connection part of a cable-shaped signal transmission medium and an inner conductor contact is provided in part of an insulative pressing plate, which is opened/closed integrally with a shell cover portion, and the wire connection part thereof and the void portion are disposed in a radial-direction inner region of a shield shell. As a result, an air layer for impedance adjustment formed by the void portion of the insulative pressing plate is disposed so as to face the wire connection part, at which mismatching of impedance easily occurs, and the matching degree (VSWR) of impedance can be efficiently adjusted.

4 Claims, 19 Drawing Sheets

(56) References Cited

U.S. PATENT DOCUMENTS

2013/0196540 A1* 8/2013 Sasaki ..... H01R 24/38 439/582
2014/0038464 A1* 2/2014 Tsai ..... H01R 13/516 439/626
2014/0206229 A1* 7/2014 Chen ..... H01R 24/38 439/582
2015/0044912 A1* 2/2015 Hashimoto ..... H01R 9/0518 439/626

FOREIGN PATENT DOCUMENTS

JP 2005-317260 11/2005
JP 2011-40262 2/2011

* cited by examiner

COAXIAL-TYPE ELECTRIC CONNECTOR

BACKGROUND OF THE INVENTION

1. Field of the Invention

The present invention relates to a coaxial-type electric connector that is used by coupling a cable-shaped signal transmission medium such as a thin-wire coaxial cable thereto.

2. Description of Related Art

Generally, as signal transmission media which are used in various electronic devices or electric devices such as mobile phones or smartphones, cable-shaped signal transmission media such as thin-wire coaxial cables are widely employed, and a coaxial-type electric connector for efficiently connecting such a cable-shaped signal transmission medium to a printed wiring substrate is known. For example, in a coaxial-type electric connector described in Japanese Patent Application Laid-Open No. 2011-40262, an external conductor shell (shield shell) consisting of an approximately hollow cylindrical member is mounted in an outer peripheral side of an insulative housing, and a shell cover portion is openably/closably coupled to an annular opening of the external conductor shell. The shell cover portion which has been in an open state when a terminal portion of a cable-shaped signal transmission medium is coupled is configured to be closed so as to be pushed down together with an internal conductor contact disposed in an inner region of the external conductor shell. As a result, the internal conductor contact is plastically deformed so as to be bent, the cable-shaped signal transmission medium therefore becomes a sandwiched state, and electrical connection is established.

According to a coaxial electric connector having such a configuration, since the solder connection operation for coupling a cable-shaped signal transmission medium such as a coaxial cable to an internal conductor contact is omitted, assembly workability is improved, problems in environmental viewpoints such as disposal of a solder material are solved, and, in addition, an advantage that differences in characteristic impedance caused by differences of used amounts of solder are eliminated is also obtained.

However, in conventional coaxial-type electric connectors, there is a tendency that the matching degree (VSWR) of the characteristic impedance with respect to transmission signals becomes a mismatched state particularly along with recent advancement in high-frequency increase of transmission signals and rapid downsizing or height reduction of the electric connectors, and it is becoming difficult to maintain good high-frequency characteristics.

Hereby, the inventors of the present patent application disclose below prior literature, Japanese Patent Application Laid-Open No. 2011-40262.

SUMMARY OF THE INVENTION

Therefore, it is an object of the present invention to provide a coaxial-type electric connector enabled to stably obtain good signal transmission characteristics by a simple configuration.

In the present invention for achieving the above described object, a coaxial-type electric connector has: an insulative housing to which a terminal part of a cable-shaped signal transmission medium is coupled, an external conductor shell consisting of an approximately hollow cylindrical member attached so as to cover an outer surface of the insulative housing, and an internal conductor contact disposed in a radial-direction inner region of the external conductor shell;

the coaxial-type electric connector configured so that: a wire connection part of the terminal part of the cable-shaped signal transmission medium and the internal conductor contact is disposed in the radial-direction inner region of the external conductor shell, a shell cover portion that opens/closes an annular opening possessed by the external conductor shell is openably/closably coupled to the annular opening, an insulative pressing plate integrally opened/closed with the shell cover portion is provided at the insulative housing, and, when the shell cover portion is closed so as to cover the annular opening of the external conductor shell, and the insulative pressing plate is deformed so as to form a bent portion, pressing force of the insulative pressing plate causes a tongue-shaped portion of the internal conductor contact to contact the cable-shaped signal transmission medium with pressure and form the wire connection part; wherein a void portion formed by an inner wall of a groove dented to form a step shape is provided in part of a surface of the insulative pressing plate and at a position facing the wire connection part of the terminal part of the cable-shaped signal transmission medium and the internal conductor contact; the void portion is configured to be disposed in the radial-direction inner region of the external conductor shell and be formed so that a bore size W1 in a width direction orthogonal to an extending direction of the cable-shaped signal transmission medium is smaller than an outer-shape size W2 in the width direction of the tongue-shaped portion of the internal conductor contact.

According to the present invention having such a configuration, the void portion formed by the inner wall of the dented groove forming the step shape in the insulative pressing plate is in a disposition relation in which it faces the wire connection part disposed in the radial-direction inner region of the external conductor shell. Therefore, the air layer for impedance adjustment formed by the void portion is disposed so as to face the wire connection part in which mismatching of impedance easily occur, and the matching degree (VSWR) of impedance which is an important design element of an electric connector is efficiently adjusted. As a result, good transmission of high-frequency signals is easily maintained while carrying out downsizing or height reduction of the electric connector.

Moreover, it is desired that the void portion of the present invention be provided in a region from the wire connection part to the bent portion so as to extend along the cable-shaped signal transmission medium.

According to the present invention having such a configuration, also in the part in which the bent portion of the insulative pressing plate is opposed to the external conductor shell in the radial direction, an air layer for impedance adjustment is formed by the void portion provided in the insulative pressing plate, matching of impedance is further efficiently carried out, and rigidity at the bent portion of the insulative pressing plate is reduced by the void portion. Therefore, an operation of bending the insulative pressing plate is easily carried out without causing breakage, etc.

Furthermore, in the present invention, it is desired that the insulative pressing plate be configured to extend along an inner wall surface of the shell cover portion disposed so as to cover the annular opening of the shield shell, and a shell-side recessed groove portion opposed to the void portion be formed on the inner wall surface of the shell cover portion.

When such a configuration is employed, in addition to the matching action of impedance by the void portion of the insulative pressing plate, impedance matching is carried out by the shell-side recessed groove portion provided on the inner wall surface of the shell cover portion. Therefore, impedance matching is further efficiently and easily carried out.

Furthermore, in the present invention, it is desired that the void portion be formed by a through hole.

When such a configuration is employed, the void portion is formed by the through hole, which can be easily manufactured. Therefore, manufacturing efficiency is improved.

As described above, in the present invention, a void portion disposed so as to face a wire connection part of a cable-shaped signal transmission medium and an inner conductor contact is provided in part of an insulative pressing plate, which is opened/closed integrally with a shell cover portion, and the wire connection part thereof and the void portion are disposed in a radial-direction inner region of an external conductor shell. As a result, an air layer for impedance adjustment formed by the void portion of the insulative pressing plate is disposed so as to face the wire connection part, at which mismatching of impedance easily occurs, and the matching degree (VSWR) of impedance can be efficiently adjusted. Therefore, by a simple configuration, good signal transmission characteristics can be stably obtained, and the reliability of an electric connector can be significantly improved at low cost.

DETAILED DESCRIPTION OF THE PREFERRED EMBODIMENT(S)

Figure 1:
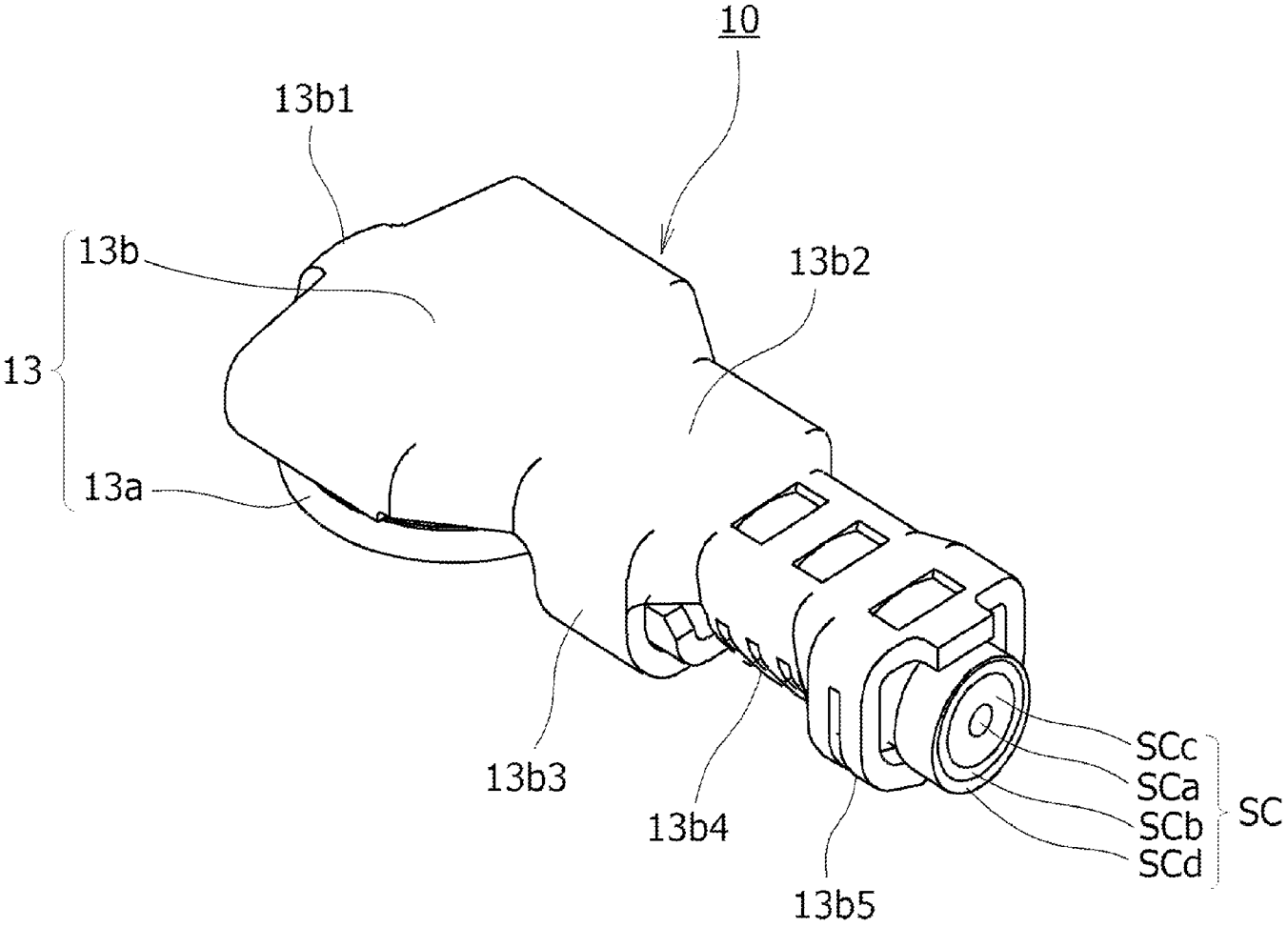
FIG. 1 is an explanatory external perspective view showing, from a front upper side, a single coaxial-type electric connector (plug connector), to which a coaxial cable is coupled, according to an embodiment of the present invention.
Figure 2:
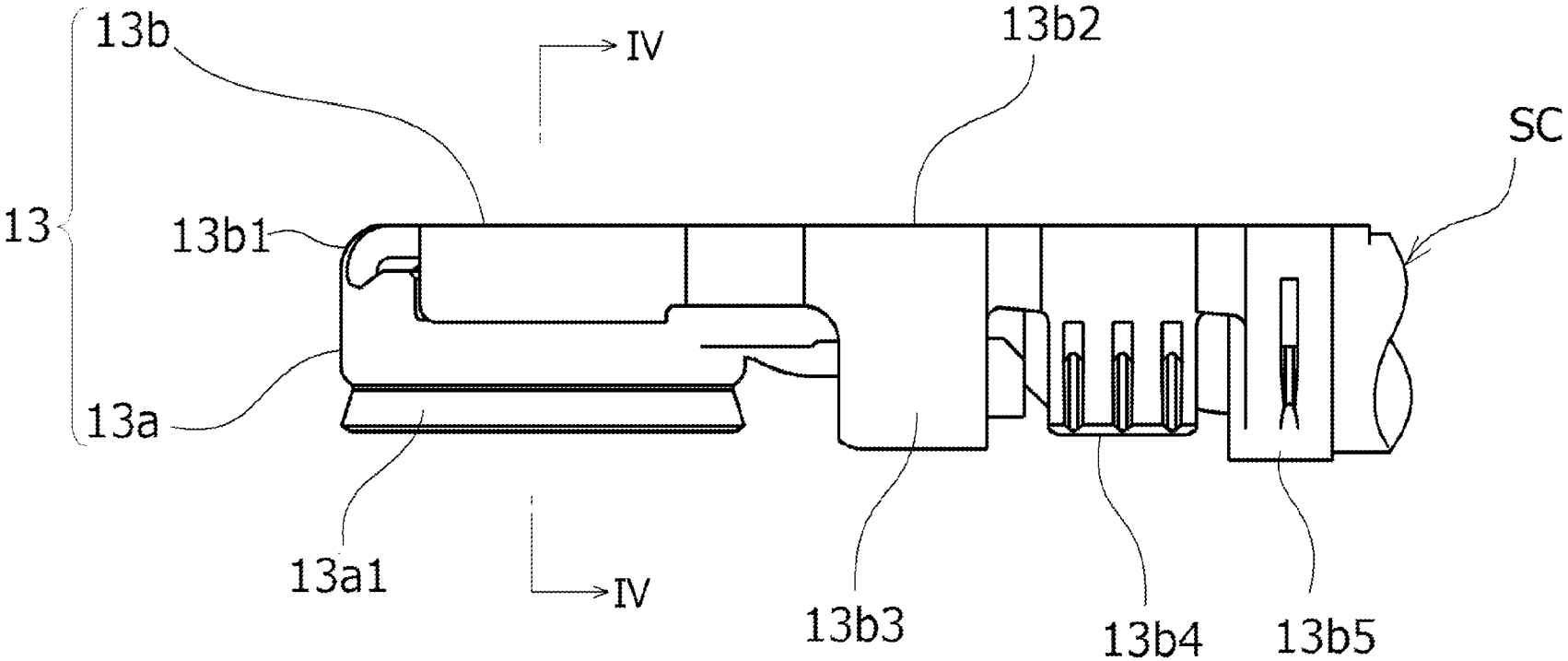
FIG. 2 is an explanatory external perspective view showing, a lateral side, the single plug connector shown in FIG. 1.
Figure 3:
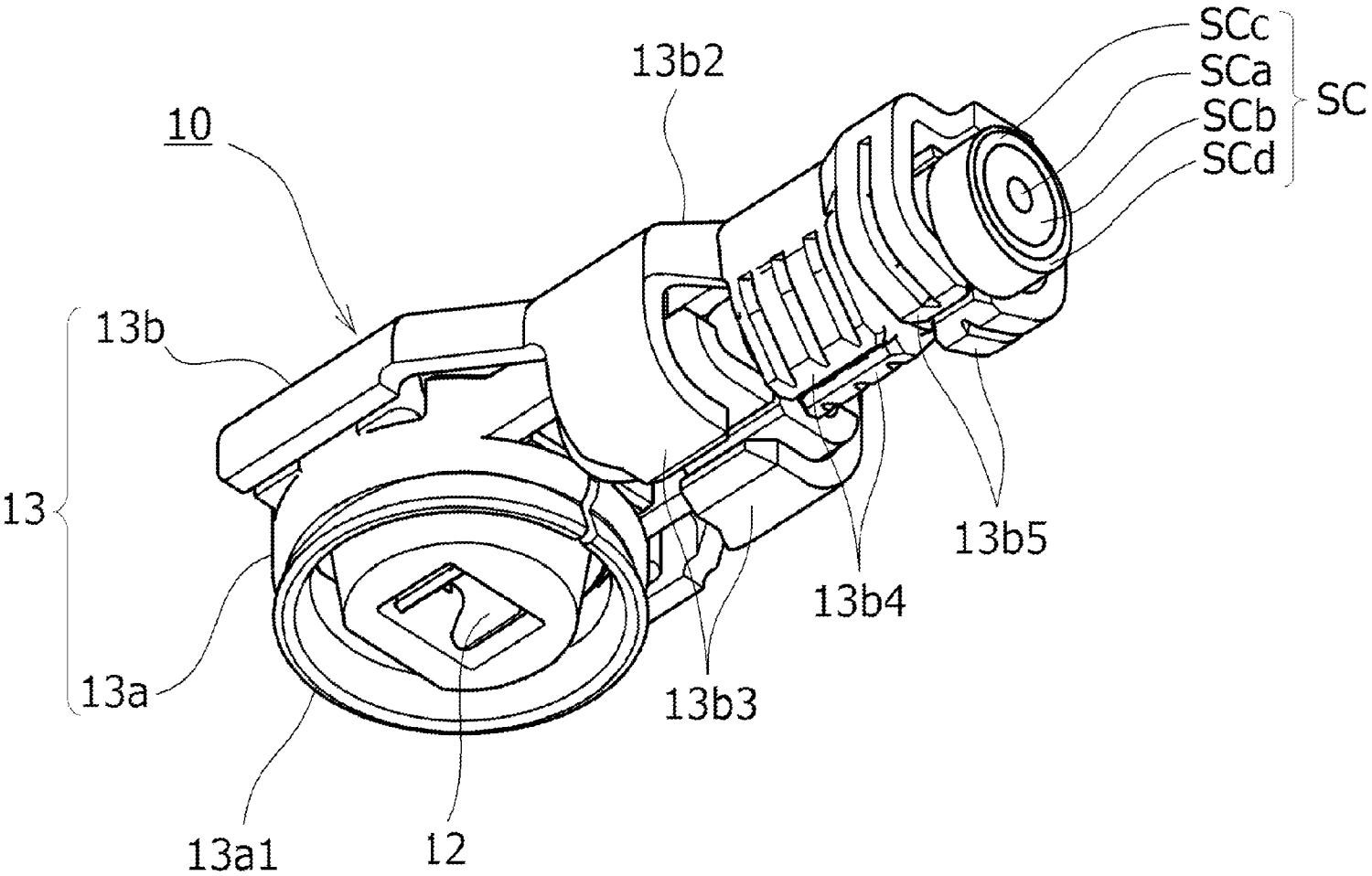
FIG. 3 is an explanatory external perspective view showing, from a front lower side, the single plug connector shown in FIG. 1 and FIG. 2.

Hereinafter, an embodiment in which the present invention is applied to a coaxial-type electric connector, which uses a thin-wire coaxial cable as a signal transmission medium, will be explained in detail based on drawings.

[About Overall Structure of Coaxial-Type Electric Connector]

First, a plug connector 10 serving as a coaxial-type electric connector according to a first embodiment of the present invention shown in FIG. 1 to FIG. 5 is configured to be coupled to a terminal part of a thin-wire coaxial cable SC serving as a cable-shaped signal transmission medium and is configured to be mated so as to be inserted from the upper side to a counterpart electric connector (illustration omitted), which consists of a receptacle connector or the like mounted on an illustration-omitted predetermined printed wiring substrate, or be removed therefrom. The operation of mating/removing the plug connector 10 with/from the counterpart electric connector (receptacle connector or the like) is carried out in a direction approximately orthogonal to the plane of the printed wiring substrate.

More specifically, a connector main-body portion constituting a main mated part of the plug connector 10 is formed so as to have a cylindrical shape as an approximate shape; a terminal portion of the thin-wire coaxial cable SC is coupled to the connector main-body portion, which has the approximately cylindrical shape, from one direction of a radial-direction outer side; and, in the state in which the thin-wire coaxial cable SC is coupled, the plug connector 10 is disposed so as to face a position above the counterpart electric connector (receptacle connector or the like). Then, when the entire plug connector 10 is moved down to the direction approximately orthogonal to the outer surface of the printed wiring substrate, a lower end part of the plug connector 10 is brought into a state in which it is mated with an upper end part of the counterpart electric connector. When the plug connector 10 is brought into the mated state in which it is inserted in the counterpart electric connector from the upper side in this manner, the terminal portion of the thin-wire coaxial cable SC is connected to a wiring-pattern electrically-conducting path on the printed wiring substrate via the plug connector 10 and the counterpart electric connector.

Herein, the direction in which the plug connector 10 is inserted to the counterpart electric connector (receptacle connector or the like) is assumed to be "downward direction", and, opposite to that, the direction in which the plug connector 10 is removed is assumed to be "upward direction". In the plug connector 10 per se, an edge part to which the terminal portion of the thin-wire coaxial cable SC is connected is assumed to be "front-side edge part", an edge part opposite to that is assumed to be "back-side edge part", furthermore, the direction from the "back-side edge part" toward the "front-side edge part" is assumed to be "connector forward direction", and the opposite direction thereof is assumed to be "connector backward direction". Moreover, the direction orthogonal to both of "connector top-bottom direction" and "connector front-back direction" is assumed to be "connector left-right direction".

[About Coaxial Cable]

Figure 6:
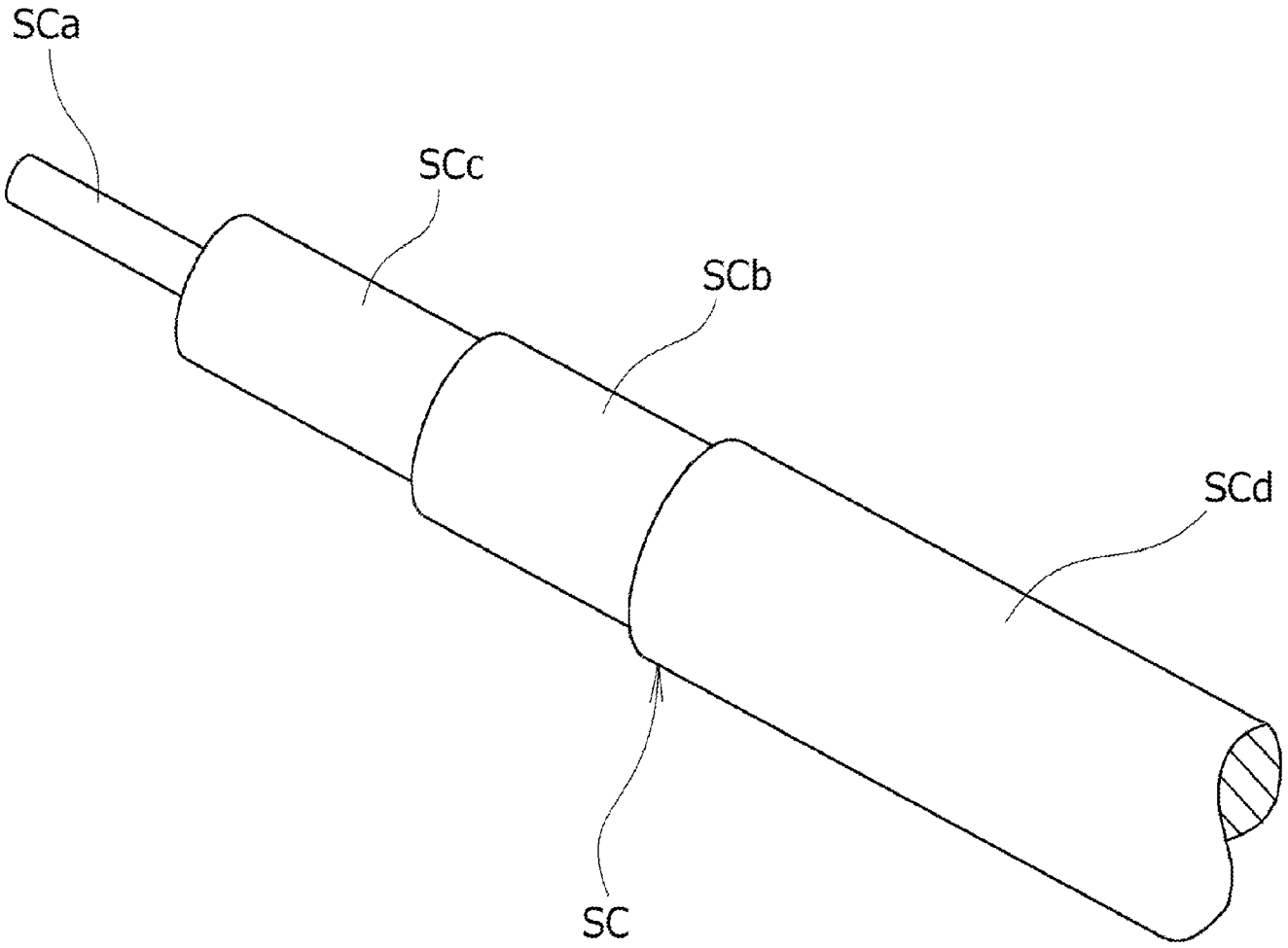
FIG. 6 is an explanatory external perspective view showing a thin-wire coaxial cable as an example of a signal transmission medium to be coupled to the coaxial-type electric connector (plug connector) according to the embodiment of the present invention.

Particularly as shown in FIG. 6, in the thin-wire coaxial cable SC serving as the cable-shaped signal transmission medium, a cable central conductor (signal wire) SCa and a cable external conductor (shield wire) SCb, which are formed by a plurality of conductive wires, are configured to be coaxially stacked via a cable dielectric body SCc, the cable external conductor (shield wire) SCb among them is caused to be in an exposed state by peeling off an outer-circumferential coating material SCd, and the cable central conductor (signal wire) SCa is caused to be in an exposed state by further peeling off the cable external conductor (shield wire) SCb and the cable dielectric body SCc.

When the cable central conductor SCa, which is disposed so as to be along the central axis of the thin-wire coaxial cable SC, is connected to an internal conductor contact (signal contact member) 12, which is attached to an insulative housing 11, a signal circuit is formed. The cable external conductor SCb, which is disposed so as to surround the outer circumferential side of the cable central conductor SCa, is connected to an external conductor shell 13*a* of a shield shell 13, and, when the external conductor shell 13*a* functions as a contact member for grounding, a ground circuit is configured to be formed.

[About Insulative Housing]

Figure 5:
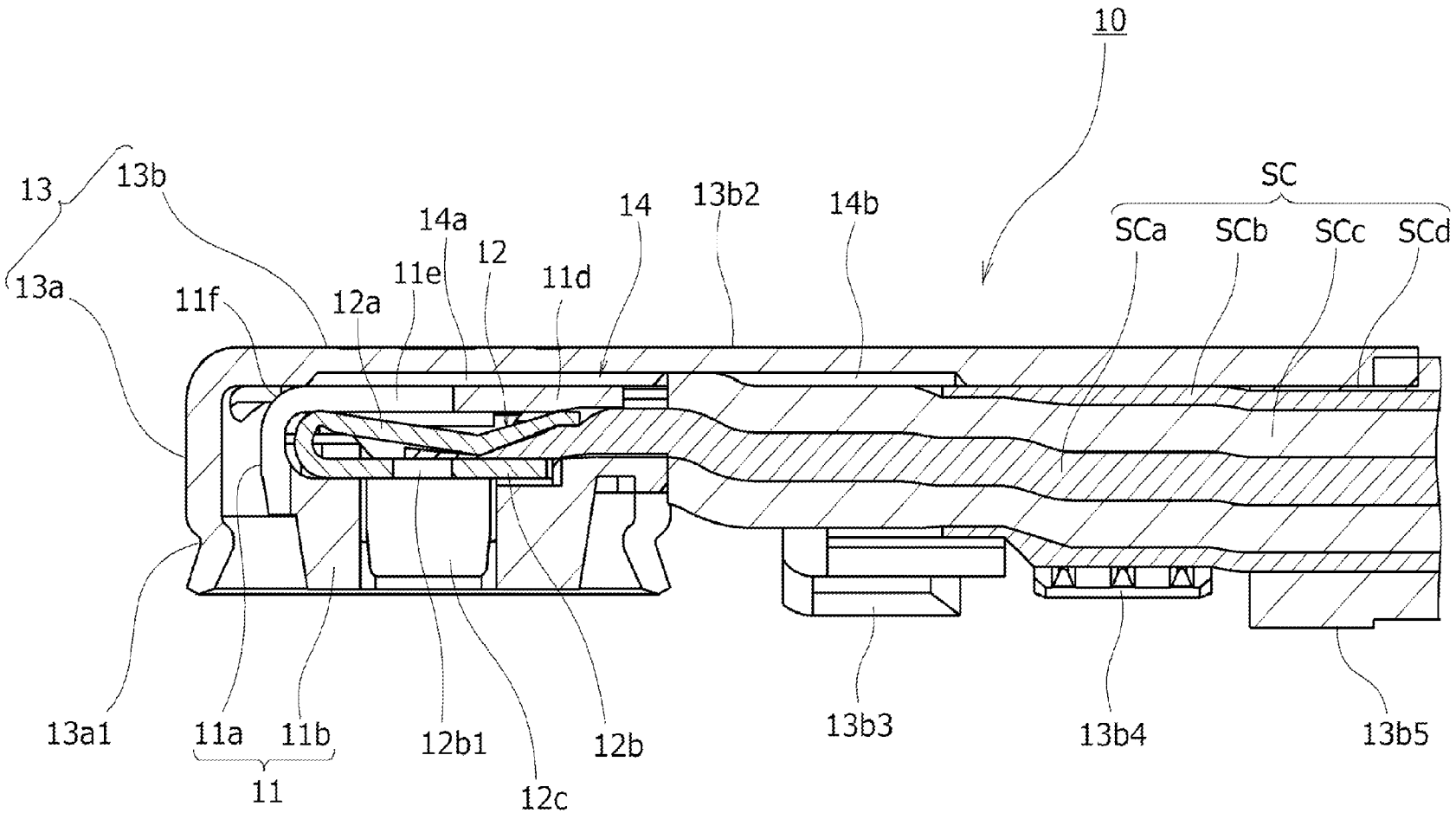
FIG. 5 is an explanatory vertical cross-sectional view taken along a line V-V in FIG. 4.

Herein, as shown in FIG. 5, the above described insulative housing 11 has an insulative main-body portion 11*a* having an approximately disk shape, which constitutes the connector main-body portion serving as a main mating part, and, at a lower part of the insulative main-body portion 11, integrally has an insulative inserting portion 11*b* inserted to the inner side of the electric connector (receptacle connector or the like) which is the mating counterpart. Among them, at an approximately central part of the insulative main-body portion 11*a*, the terminal part of the above described thin-wire coaxial cable SC, and the internal conductor contact (signal contact member) 12 on which the cable central conductor (signal wire) SCa of the thin-wire coaxial cable SC is to be placed is attached to the part that is formed in a recessed shape at an approximately central part of the upper surface of the insulative main-body portion 11*a*.

The external conductor shell 13*a* of the shield shell 13 serving as a ground contact is attached to the above described insulative main-body portion 11*a* so as to surround the periphery of the above described internal conductor contact 12 from the outer side. Furthermore, a cable supporting portion 11*c* (see FIG. 7), which consists of a recessed groove forming an approximately semicircular shape in a front view, is formed at the front-side edge part of the insulative main-body portion 11*a*, and the terminal part of the above described thin-wire coaxial cable SC is configured to be placed on and received by the inner-side wall surface of the cable supporting portion 11*c*.

Figure 12:
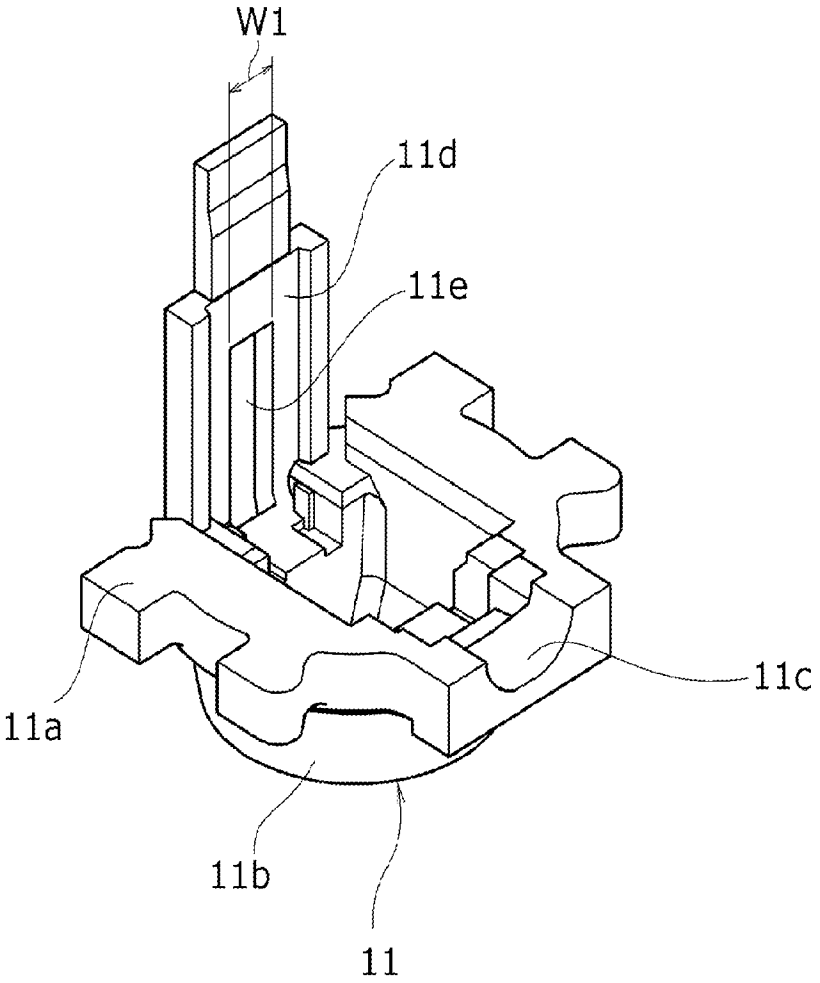
FIG. 12 is an explanatory external perspective view showing an initial open state of an insulative housing used in the coaxial-type electric connector (plug connector) according to the embodiment of the present invention.
Figure 13:
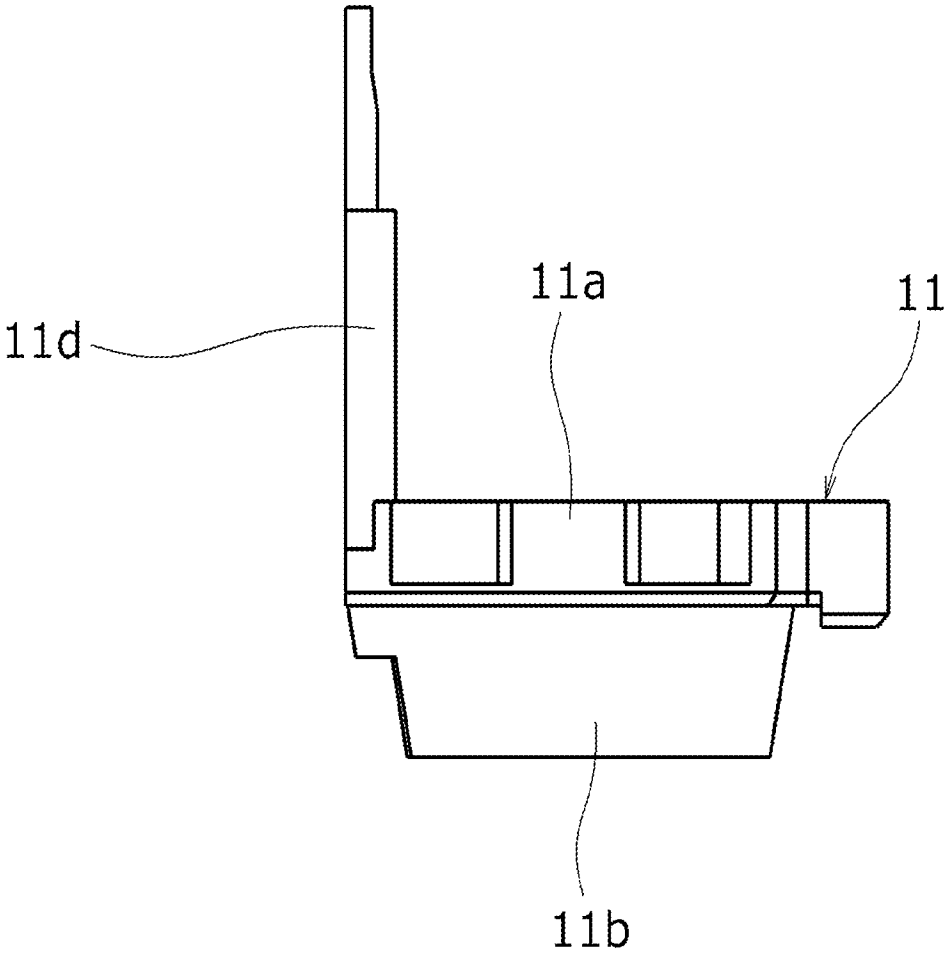
FIG. 13 is an explanatory lateral view of the single insulative housing shown in FIG. 12.
Figure 14:
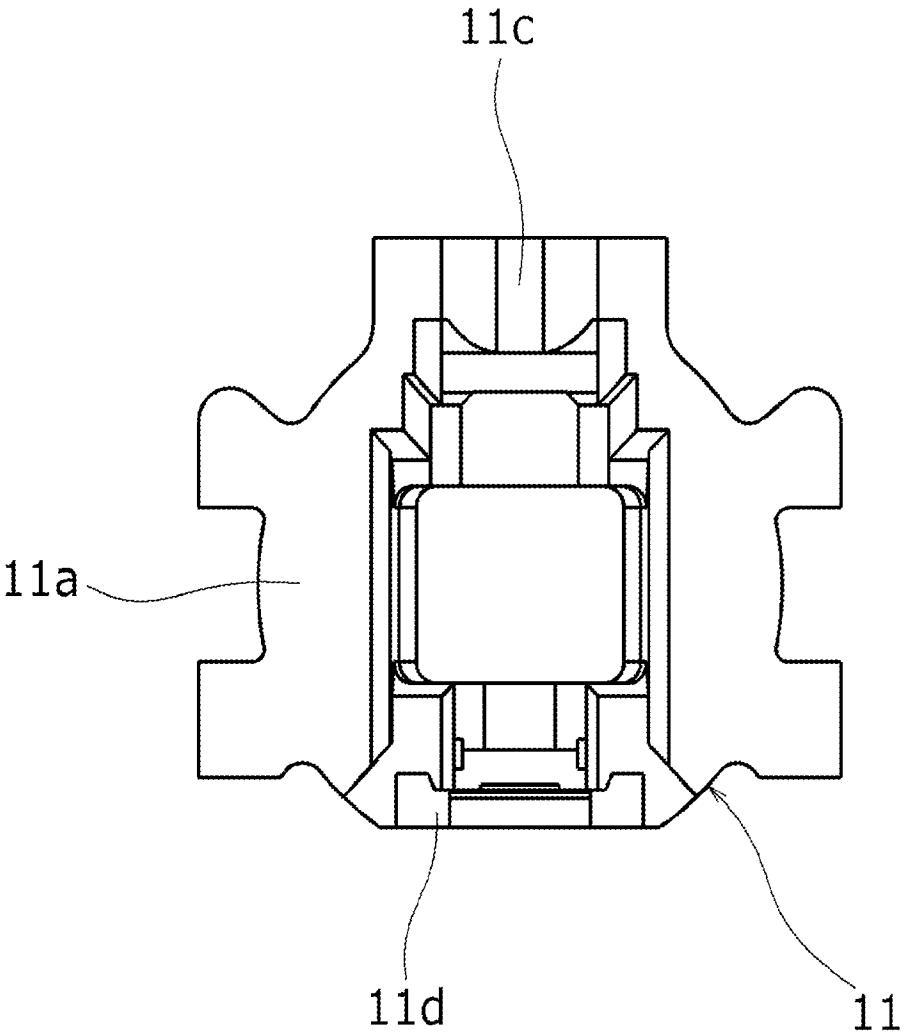
FIG. 14 is an explanatory plan view of the single insulative housing shown in FIG. 12 and FIG. 13.

Furthermore, an insulative pressing plate 11*d* consisting of a tongue-shaped member is integrally provided with the insulative main-body portion 11*a* of the above described insulative housing 11 so as to cover the cable central conductor SCa of the thin-wire coaxial cable SC from the upper side. The insulative pressing plate 11*d* is formed by a long and thin flat-plate-shaped member, which forms a cantilever shape from a connector-rear-end-side edge of the insulative main-body portion 11*a* and is projecting so as to be along the thin-wire coaxial cable SC, and, in an initial state before the terminal part of the thin-wire coaxial cable SC is placed particularly as shown in FIG. 12 to FIG. 14, the insulative pressing plate 11*d* is in an open state in which it is raised to the upper side. Then, after the terminal part of the thin-wire coaxial cable SC is set at the insulative housing 11, the insulative pressing plate 11*d* is bent the lower side together with a shell cover portion 13*b*, which is provided in the shield shell 13 as described later, and the part extending to form a flat plate shape from a bent portion 11*f*, which is formed in this process, is disposed so as to be overlapped from the upper side along the thin-wire coaxial cable SC.

Figure 15:
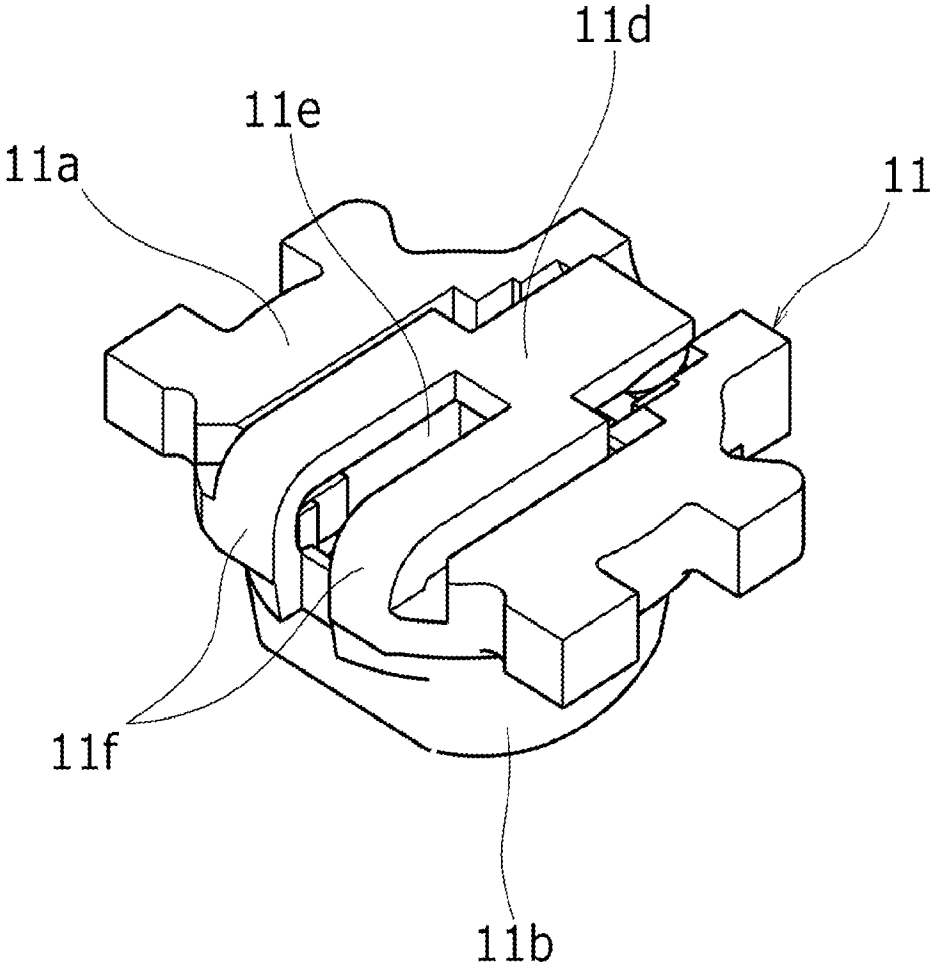
FIG. 15 is an explanatory external perspective view showing a closed state after an insulative pressing plate provided in the insulative housing shown in FIG. 12 to FIG. 13 is bent.
Figure 16:
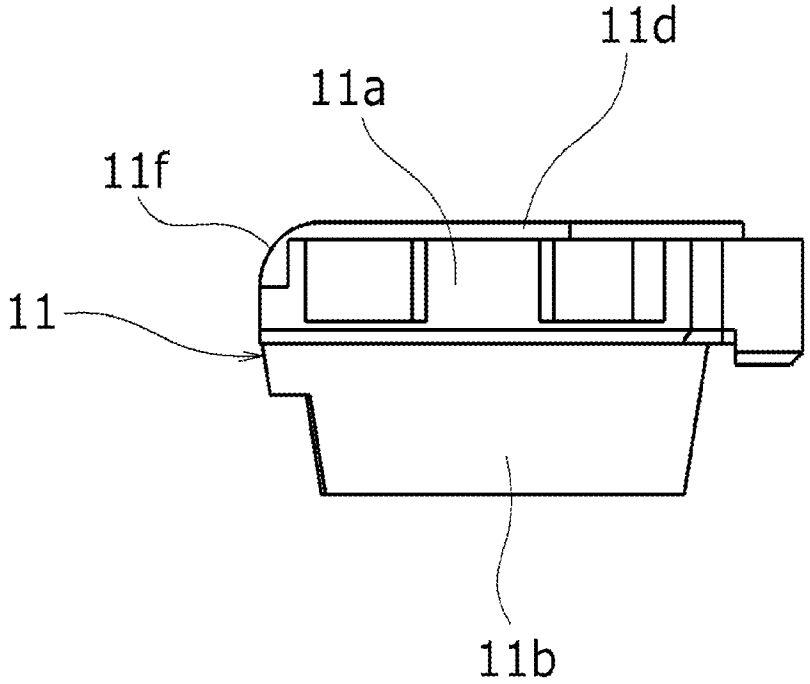
FIG. 16 is an explanatory lateral view of the insulative housing shown in FIG. 14.

Herein, in a root-base-side region of the insulative pressing plate 11*d*, which is extending to form the cantilever shape as described above, a void portion 11*e* consisting of a through hole which is extending in a long and thin shape along the extending direction of the thin-wire coaxial cable SC is provided. At an approximately central part of the insulative pressing plate 11*d* in a width direction, which is orthogonal to the extending direction of the thin-wire coaxial cable SC, the void portion 11*e* is formed by the inner wall surfaces of a groove (a through hole in the present embodiment) dented like a step from the surface of the insulative pressing plate 11*d* in a plate thickness direction. As shown in FIG. 15 and FIG. 16, when the insulative pressing plate 11*d* is bent to the lower side and disposed in the upper side of the thin-wire coaxial cable SC, the above described void portion 11*e* is disposed at the insulative pressing plate 11*d*, and an air layer formed in a long and thin shape by the inner wall surfaces of the void portion 11*e* is configured to be disposed so as to face, from the upper side, a "wire connection part", which is an electrical connection region of the cable central conductor (signal wire) SCa and the internal conductor contact 12.

Figure 4:
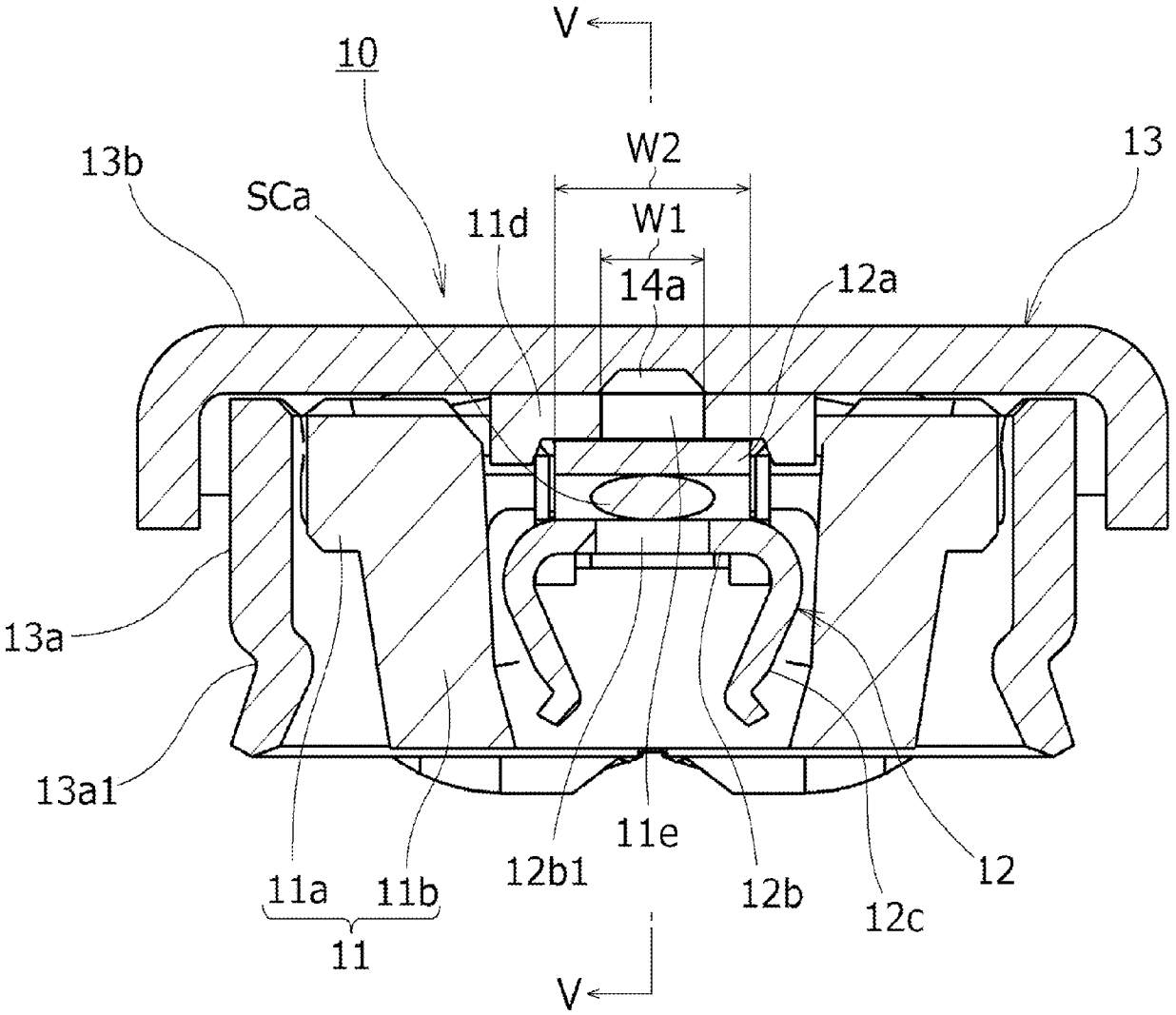
FIG. 4 is an explanatory transverse cross-sectional view taken along a line IV-IV in FIG. 2.

The void portion 11*e*, which consists of the through hole as described above, is disposed in the radial-direction inner region of the external conductor shell (ground contact member) 13; wherein, particularly as shown in FIG. 4, a bore size W1 in a width direction (the direction orthogonal to the extending direction of the thin-wire coaxial cable SC) of the void portion 11*e* is formed to be smaller than a width-direction outer-shape size W2 of an upper beam portion (tongue-shaped portion) 12*a*, which forms part of the above described internal conductor contact (signal contact member) 12 (W1<W2). The structure of the upper beam portion (tongue-shaped portion) 12*a* of the internal conductor contact 12 will be explained later in detail; wherein, it is structured to form the "wire connection part" with respect to the thin-wire coaxial cable SC when the upper beam portion 12*a*, which forms the tongue-shaped portion, contacts the thin-wire coaxial cable SC with a pressure from the upper side.

According to the width magnitude relation (W1<W2) possessed by the void portion 11*e* with respect to the upper beam portion (tongue-shaped portion) 12*a* of the internal conductor contact 12, when the insulative pressing plate 11*d* is in a relation that the insulative pressing plate 11*d* abuts the internal conductor contact 12 when bent toward the lower side, and, by virtue of that, both of the members 11*d* and 12 are configured to be integrally bent.

Herein, particularly as shown in FIG. 5, the void portion 11*e*, which is provided in the insulative pressing plate 11*d* in the above described manner, is disposed in a state in which the void portion 11*e* faces, from the upper side, the "wire connection part" serving as the electrical connection region of the cable central conductor (signal wire) SCa of the thin-wire coaxial cable SC and the internal conductor contact 12, is further extending from the position facing the "wire connection part" toward the root-base side of the insulative pressing plate 11*d*, which is the connector rear side, is extending so as to be curved along the bent portion 11*f* formed in the insulative pressing plate 11*d*, and is then extending toward the lower side.

On the other hand, with respect to the insulative main-body portion 11*a* of the insulative housing 11 constituting the main mating part including the insulative pressing plate 11*d* like this, the insulative inserting portion 11*b* consisting of an approximately hollow cylindrical shape integrally projecting from the insulative main-body portion 11*a* toward the lower side is configured so that the lower end side of the insulative inserting portion 11*b* is inserted into the inner side of the counterpart electric connector (receptacle connector or the like) serving as a counterpart as described above.

[About Shield Shell]

Figure 10:
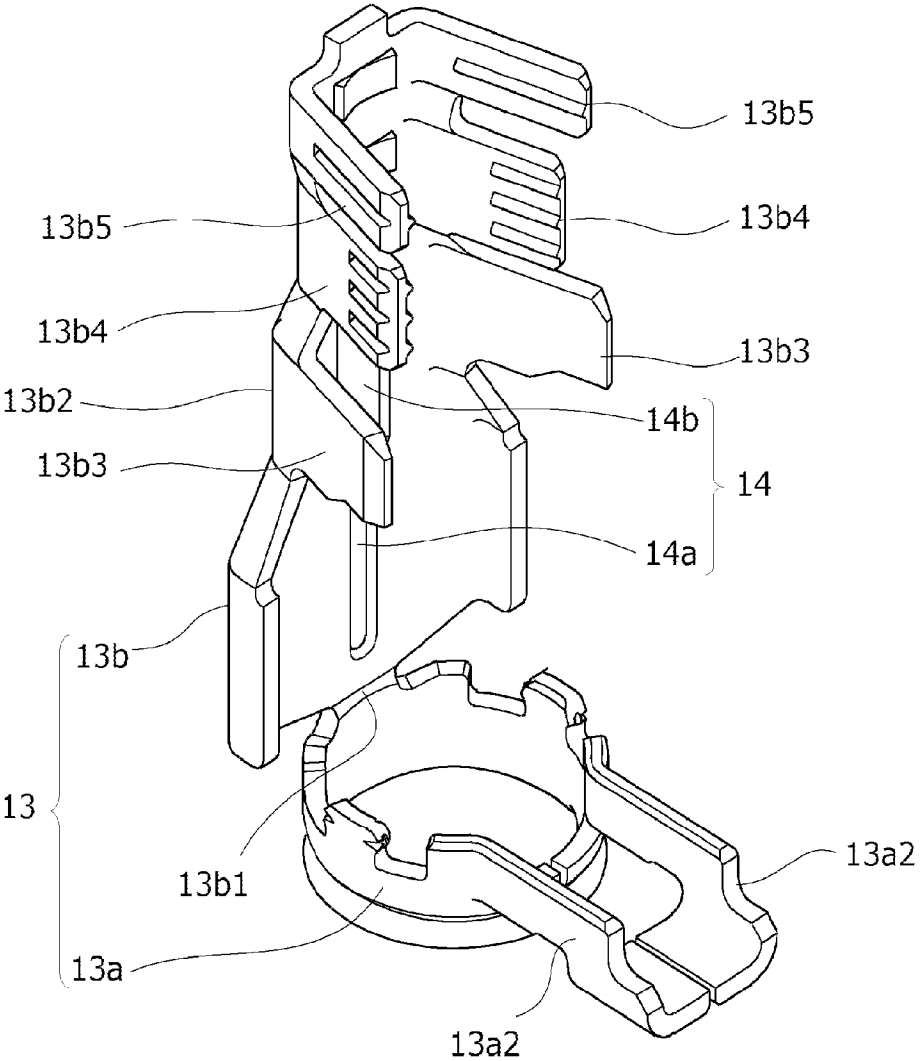
FIG. 10 is an explanatory external perspective view showing an initial open state of a single shield shell used in the coaxial-type electric connector (plug connector) according to the embodiment of the present invention.
Figure 11:
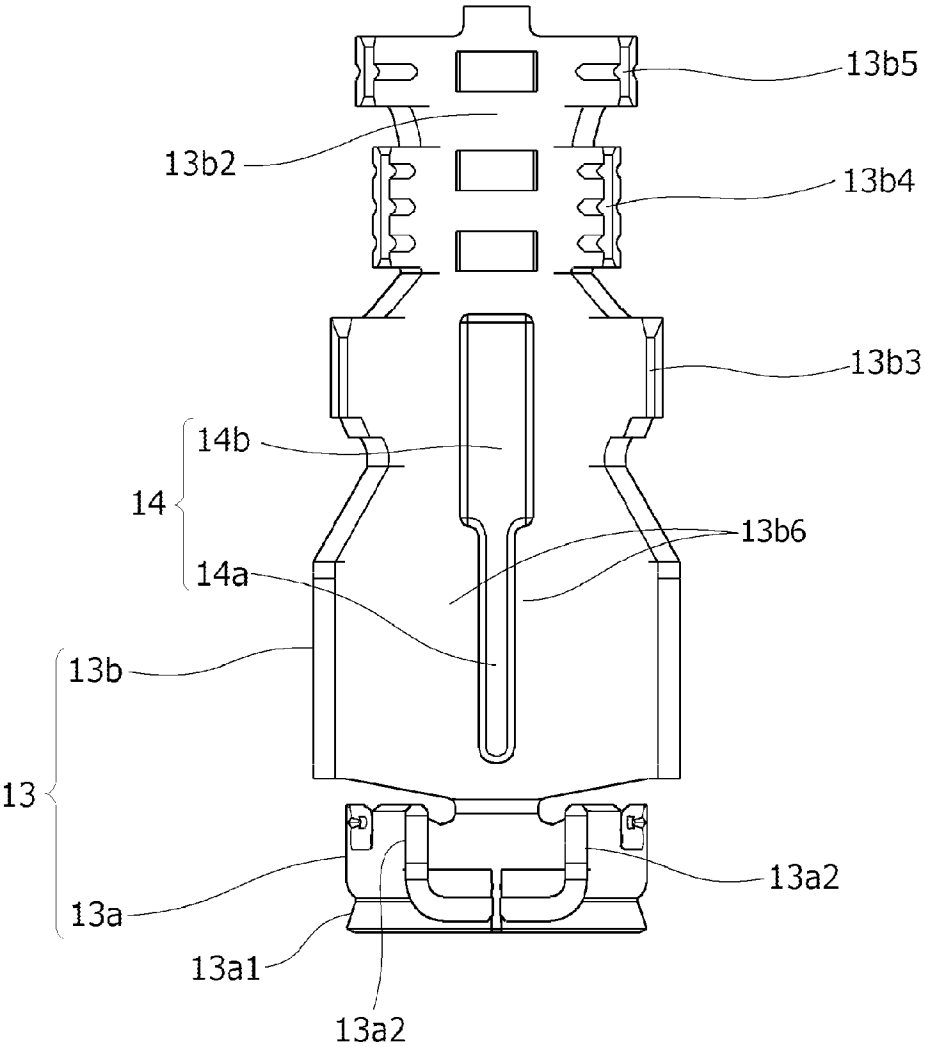
FIG. 11 is an explanatory front view of the single shield shell shown in FIG. 10.

Furthermore, as shown in FIG. 10 and FIG. 11, the outer surface of the insulative housing 11 having the insulative main-body portion 11*a* and the insulative inserting portion 11*b* described above is covered by the external conductor shell 13*a*, which constitutes the main mating part of the shield shell 13 consisting of a metal thin-plate-shaped member. The external conductor shell 13*a* constitutes the ground contact member having an approximately hollow cylindrical shape formed so as to annularly mainly cover the insulative main-body portion 11*a* of the insulative housing 11 from the radial-direction outer side. A lower part of the external conductor shell (ground contact member) 13*a* is formed into a shell inserting portion 13*a*, which annularly covers the above described insulative inserting portion 11*b* from the radial-direction outer side, and the shell cover portion 13*b* covering the upper surface side of the above described insulative main-body portion 11*a* is openably/closably coupled to an upper-end-side annular opening part of the external conductor shell 13*a*.

Herein, particularly as shown in FIG. 7 to FIG. 12, the shield shell 13, which is in the initial state before the terminal part of the thin-wire coaxial cable SC is connected and fixed, is in a state in which the shell cover portion 13*b* is opened to the upper side with respect to the above described external conductor shell 13*a*. In other words, the shell cover portion 13*b* in the initial state is disposed at a rear-side edge part of the external conductor shell 13*a* so as to be raised to the approximately vertically upper side via a connecting member 13*b*1 consisting of a narrow plate-shaped member. Moreover, at a cover inner surface of the shell cover portion 13*b*, in other words, at the surface positioned in the inner side when the shell cover portion 13*b* is closed, the insulative pressing plate 11*d* consisting of the tongue-shaped member raised from the insulative main-body portion 11*a* of the insulative housing 11 to the upper side is disposed so as to be along the cover inner surface of the shell cover portion 13*b*. Note that the installed position and the installed number of the connecting member(s) 13*b*1 can be arbitrarily selected.

In the open state (initial state) of the shield shell 13 as described above, after the terminal part of the thin-wire coaxial cable SC is placed and set so as to be received by the cable supporting portion 11*c* of the insulative housing 11, when the shell cover portion 13*b* of the shield shell 13 is pushed down to an approximately horizontal state so that the connecting member 13*b*1 is bent at approximately right angle together with the insulative pressing plate 11*d* toward the lower side, the entire insulative main-body portion 11*a* of the insulative housing 11 is covered by the shell cover portion 13*b* from the upper side as a result, and the shield shell 13 becomes a closed state.

The shell cover portion 13*b* in this case has a covering structure so that, when the shell cover portion 13*b* is pushed down to the approximately horizontal state and closed as described above, the shell cover portion 13*b* covers the upper-end-side annular opening part of the external conductor shell 13*a*; wherein, a front cover portion 13*b*2, which covers particularly the cable dielectric body SCc and the cable external conductor (shield wire) SCb of the thin-wire coaxial cable SC from the upper side is integrally continued to a front-side part of the shell cover portion 13*b*, which is pushed down to the approximately horizontal state. The front cover portion 13*b*2 is configured to cover a pair of cable protecting arms 13*a*2 and 13*a*2, which are projecting from the above described external conductor shell 13*a* to the front side, from the outer side together with the thin-wire coaxial cable SC.

In this case, the above described cable protecting arms 13*a*2 and 13*a*2 are configured to extend along left-right-direction both sides sandwiching the thin-wire coaxial cable SC, and the paired arms are provided so as to project from the front-side edge part of the above described conductor shell 13*a* to the front side so as to be opposed and approximately in parallel with each other along the terminal part of the thin-wire coaxial cable SC.

Moreover, at both-side edge portions of the front cover portion 13*b*2, which is provided so as to project from the front side of the shell cover portion 13*b* in the above described manner, first fixation retaining plates 13*b*3, second fixation retaining plates 13*b*4, and third fixation retaining plates 13*b*5 consisting of pair of tongue-shaped members are provided so as to form flange plate shapes. Among them, the first fixation retaining plates 13*b*3 are configured to be bent and swage-fixed so as to cover the thin-coaxial cable SC and the cable protecting arms 13*a*2 and 13*a*2.

In other words, the both-side flange plates constituting the pair of first fixation retaining plates 13*b*3 and 13*b*3 are disposed so as to be positioned at both-side outer sides of the cable protecting arms 13*a*2 and 13*a*2 when the shell cover portion 13*b* is pushed down to the approximately horizontal state and are bent to the connector inner side along both-side outer wall surfaces of the cable protecting arms 13*a*2 and 13*a*2 so as to carry out swaging from this state; as a result, fixation of the shell cover portion 13*b* with respect to the external conductor shell 13*a* is carried out, and particularly the cable dielectric body SCc of the thin-wire coaxial cable SC is fixed to the shell cover portion 13*b*.

Furthermore, the second fixation retaining plates 13*b*4 and the third fixation retaining plates 13*b*5 are provided so as to be adjacent and juxtaposed to the front side of the above described first fixation retaining plates 13*b*3 and are formed by comparatively small flange plates. The second fixation retaining plates 13*b*4 and the third fixation retaining plates 13*b*5 are configured to be bent and swage-fixed so as to cover the cable external conductor (shield wire) SCb and the outer-circumferential coating material SCd of the thin-wire coaxial cable SC from the outer side.

In other words, when the shell cover portion 13*b* is pushed down to the approximately horizontal state, the both-side flange plates constituting the second fixation retaining plates 13*b*4 and the third fixation retaining plates 13*b*5 are disposed at the positions in both-side outer sides of the cable external conductor (shield wire) SCb and the outer-circumferential coating material SCd of the thin-wire coaxial cable SC and, from this state, are bent to the connector inner side so as to carry out swaging. As a result, fixation of the shell cover portion 13*b* with respect to the cable external conductor (shield wire) SCb and the outer-circumferential coating material SCd of the thin-wire coaxial cable SC is carried out, and the cable external conductor SCb contacts the second fixation retaining plates 13*b*4, thereby forming a ground circuit by the shield shell 13.

On the other hand, the shell inserting portion 13*a*1, which is constituting the lower-side part of the shield shell 13 as described above, is configured to be externally mated with a radial-direction outer-side part of the counterpart connector (receptacle connector or the like), which is a mating counterpart, and constitutes a connector coupling part together with the insulative inserting portion 11*b* of the insulative housing 11, which is to be inserted in the above described radial-direction inner side of the counterpart connector. More specifically, the shell inserting portion 13*a*1 is formed so as to have an approximately cylindrical shape, and a coupling engagement portion consisting of an annular recessed groove projecting toward the radial-direction inner side is formed in a lower end part of the inserting side of the shell inserting portion 13*a*1. After the shell cover portion 13*b* is pushed down to the approximately horizontal state in the above described manner, the coupling engagement portion is configured to be in an elastically mated relation with respect to a coupling lock portion (illustration omitted), which is provided at the counterpart connector serving as the mating counterpart.

[About Signal Contact Member]

The internal conductor contact (signal contact member) 12 employed in the present embodiment is attached to the insulative main-body portion 11*a* of the above described insulative housing 11 by, for example, press fitting or insert molding, has a cable sandwiching portion consisting of a pair of upper/lower beam portions 12*a* and 12*b* to be connected to the cable central conductor (signal wire) SCa of the thin-wire coaxial cable SC, and is configured so that elastic spring portions 12*c* provided so as to extend from the lower beam portion 12*b* of the cable sandwiching portion toward the lower side elastically contact an electrically-conductive contact (illustration omitted) provided at the mating counterpart connector (receptacle connector or the like).

The upper beam portion 12*a* and the lower beam portion 12*b* constituting the cable sandwiching portion is formed by a continuously extending band-plate-shaped member and have a clip beam structure formed to be bent so as to form an approximately C shape or an approximately L shape in a lateral view. They are structured to form the "wire connection part" referred to in the present invention by sandwiching the cable central conductor (signal wire) SCa of the thin-wire coaxial cable SC between both of the beam portions 12*a* and 12*b* from the upper and lower sides like a clip by bending and deforming the coupled part of both of them in the direction in which the upper beam portion 12*a* gets closer to the lower beam portion 12*b* in a later described manner.

Figure 7:
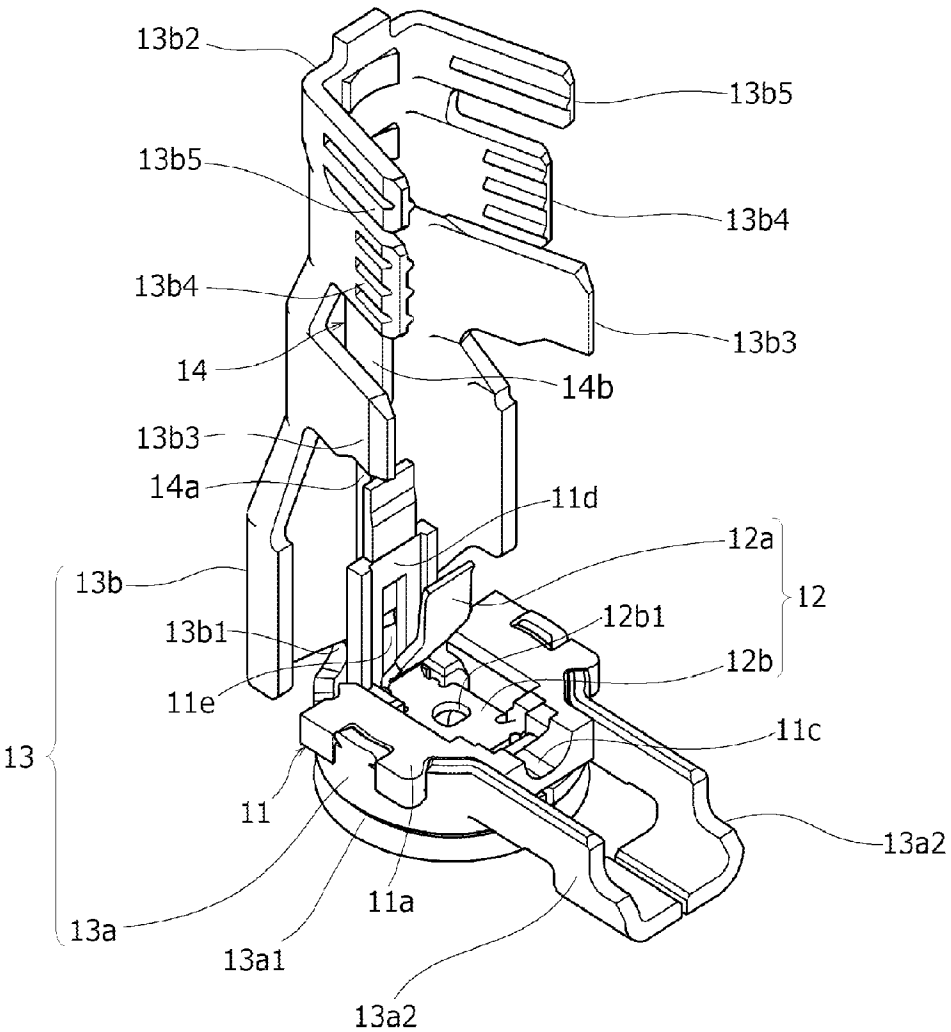
FIG. 7 is an explanatory external perspective view showing an initial open state (cable uncoupled state) of the coaxial-type electric connector (plug connector) according to the embodiment of the present invention.
Figure 8:
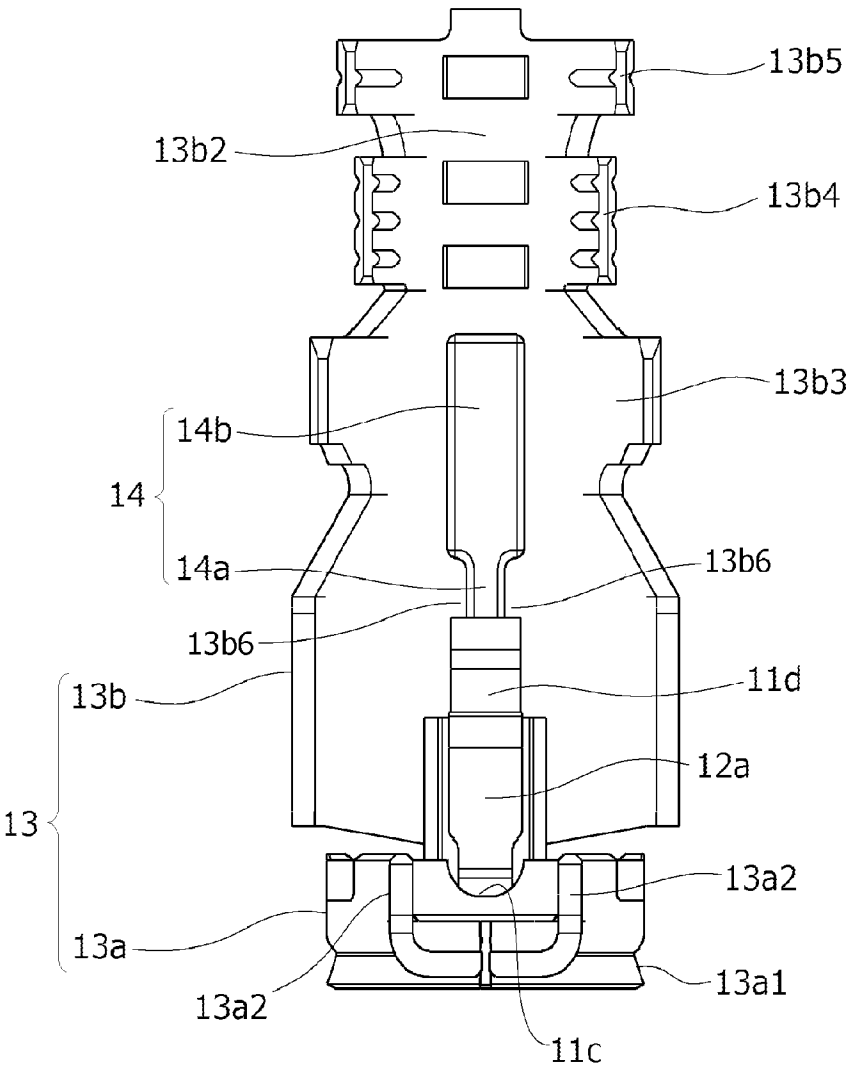
FIG. 8 is an explanatory front view of the coaxial-type electric connector (plug connector) shown in FIG. 7.
Figure 9:
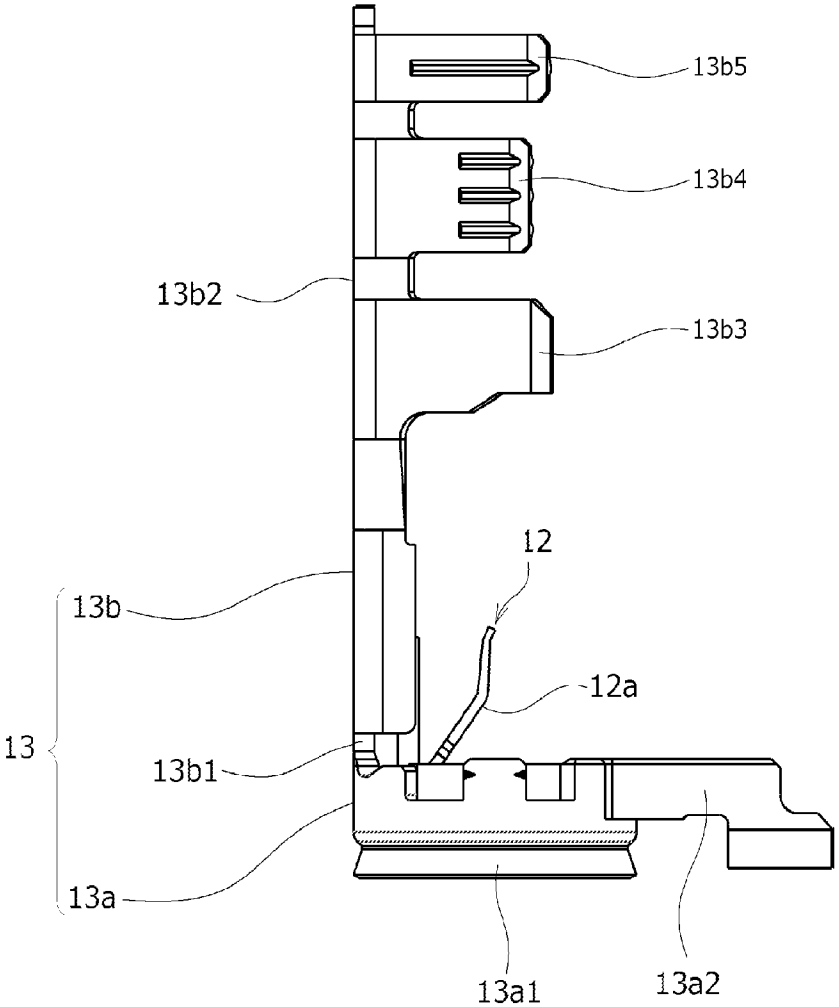
FIG. 9 is an explanatory lateral view of the coaxial-type electric connector (plug connector) shown in FIG. 7 and FIG. 8.

Herein, in the initial state which is a stage before the terminal part of the above described thin-wire coaxial cable SC is coupled, the upper beam portion 12*a* of the cable sandwiching portion is formed so as to form a tongue-shaped portion raised to an obliquely upper side particularly as shown in FIG. 7 to FIG. 9 and is in a state separated from the lower beam portion 12*b* to the upper side since the upper beam portion 12*a* serving as the tongue-shaped portion is in an upper-side open state.

On the other hand, the lower beam portion 12*b* of the cable sandwiching portion is formed as a cable placement portion on which the cable central conductor SCa of the thin-wire coaxial cable SC is to be placed and is extending approximately horizontally from the part coupled to the upper beam portion (tongue-shaped portion) 12*a* toward the connector front side. When the terminal part of the thin-wire coaxial cable SC is placed on the cable supporting portion 11*c* of the insulative housing 11 in the above described manner, the cable central conductor SCa of the thin-wire coaxial cable SC is placed on the surface of the lower beam portion 12*b* of the cable sandwiching portion from the upper side.

After the terminal part of the thin-wire coaxial cable SC is placed on the cable supporting portion 11*c* of the insulative housing 11 and brought into a set state in this manner, the shell cover portion 13*b* of the shield shell 13 is pushed down to an approximately horizontal state together with the above described insulative pressing plate 11*d*. In that process, the upper beam portion (tongue-shaped portion) 12*a* of the cable sandwiching portion pushed to the lower side by the insulative pressing plate 11*d* is bent and deformed so as to be pushed down to an approximately horizontal state, and the upper beam portion 12*a* is configured to press the cable central conductor (signal wire) SCa from the upper side particularly as shown in FIG. 5.

Herein, an extending-direction intermediate position of the upper beam portion (tongue-shaped portion) 12*a* constituting the above described cable sandwiching portion is formed into an upper-side electrode portion, which presses the cable central conductor (signal wire) SCa from the upper side. The upper-side electrode portion provided on the upper beam portion 12*a* of the signal contact member 12 is formed in a bent shape which projects in a downward direction to sandwich the thin-wire coaxial cable SC, and a lower-side bent-shape part thereof is formed into a projection-shaped contact portion projecting toward the thin-wire coaxial cable SC side. When the shell cover portion 13*b* is pushed down to the approximately horizontal state as described above, the projection-shaped contact portion is configured to contact, from the upper side with pressure, the cable central conductor (signal wire) SCa of the thin-wire coaxial cable SC set on the lower beam portion 12*b*, the cable central conductor (signal wire) SCa is sandwiched in a pressure-contacted state between both of the beam portions 12*a* and 12*b*, and electrical connection is configured to be established.

The electrical connection region in which the cable central conductor (signal wire) SCa of the thin-wire coaxial cable SC is connected to the internal conductor contact (signal contact member) 12 in this manner is referred to as "wire connection part" in the present invention as described above.

The lower beam portion 12*b* provided as the cable placement portion of the above described internal conductor contact 12 is formed by a plate-shaped member which forms a flat shape and is extending to the front side from the part coupled to the upper beam portion 12*a*, which forms the tongue-shaped portion, and the lower beam portion 12*b* is fixed in a state in which it is placed on the upper surface of the insulative main-body portion 11*a* of the above described insulative housing 11. At an approximately central part of the lower beam portion 12*b*, a connection monitoring hole 12*b*1, which forms a round hole shape, is formed to penetrate therethrough, and a contact insertion hole of the counterpart connector is formed to penetrate through the insulative housing 11 so as to form an approximately coaxial shape with the connection monitoring hole 12*b*1. The contact insertion hole of the counterpart connector also serves as a connection monitoring hole, and the disposition state of the cable central conductor (signal wire) SCa of the thin-wire coaxial cable SC can be visually checked from the lower side through the above described connection monitoring hole 12*b*1.

Furthermore, the lower beam portion 12*b* of the cable sandwiching portion is formed by the band-shaped member extending in the connector front-back direction as described above, the pair of elastic spring portions 12*c* and 12*c* are integrally extending with a predetermined interval therebetween from the plate-thickness-direction (left-right direction) both-side edge portions of the lower beam portion 12*b* toward the lower side, and a signal electrically-conductive contact (illustration omitted) having a pin shape provided on the mating counterpart connector (receptacle connector or the like) is configured to be inserted in the part between both of the elastic spring portions 12*c* and 12*c* in a pressure contacted state and electrically connected thereto.

Herein, when the shell cover portion 13*b* of the shield shell 13 which is in the upper-side open state in the initial state as described above is pushed down toward the lower side, the insulative pressing plate 11*d* which is also in the upper-side open state in the initial state is opposed to a predetermined region of the cover inner surface of the shell cover portion 13*b* from the lower side and brought into a pressure contacted state, and the insulative pressing plate 11*d* is then pushed down to an approximately horizontal state together with the shell cover portion 13*b*. Then, the shell cover portion 13*b* and the insulative pressing plate 11*d* are disposed in a laminated shape in the upper side of the cable central conductor (signal wire) SCa via the upper beam portion (tongue-shaped portion) 12*a* of the internal conductor contact (signal contact member) 12. At this point, in the region opposed to the pressure-contacted cover inner surface of the shell cover portion 13*b* and the insulative pressing plate 11*d*, a long and thin shell-side recessed groove portion 14 is provided so as to extend in the connector front-back direction along the cable-shaped signal transmission medium SC.

The shell-side recessed groove portion 14 in the present embodiment is configured to dent part of the inner surface of the shell cover portion 13*b* in a step shape in the plate thickness direction, and an air layer formed by an inner wall surface of the shell-side recessed groove portion 14 is in a disposition relation in which the air layer is opposed to the air layer, which is formed by the void portion 11*e* of the above described insulative pressing plate 11*d*, from the upper side. By virtue of the disposition relation in which the shell-side recessed groove portion 14 and the void portion 11*e* are overlapped in a mutually opposed state in the top-bottom direction, the air layers for adjusting the impedance of transmission signals are formed in an overlapped state in the part between both of the members 14 and 11*e*.

The shell-side recessed groove portion 14 in the present embodiment is formed, for example, by press working and is provided by reducing the plate thickness of the shell cover portion 13*b* by the amount of the groove depth of the shell-side recessed groove portion 14. However, depending on the adjustment amount of impedance, there can be a case in which the shell-side recessed groove portion 14 is not provided.

The shell-side recessed groove portion 14 is extending along the cable-shaped signal transmission medium SC as described above; wherein the extending range in the longitudinal direction of the shell-side recessed groove portion 14 is set in a range from the coupling part of the lower beam portion (cable placement portion) 12*b* and the upper beam (tongue-shaped portion) 12*a*, which is the rear end portion of the internal conductor contact (signal contact member) 12, to the position above the part at which the dielectric body SCc of the cable-shaped signal transmission medium SC is exposed.

More specifically, particularly as shown in FIG. 10 and FIG. 11, the shell-side recessed groove portion 14 in the present embodiment is provided with a narrow groove portion 14*a* positioned above the wire connection part which is the region in which the cable central conductor SCa of the thin-wire coaxial cable SC is electrically connected and a wide groove portion 14*b* positioned above the dielectric body SCc of the thin-wire coaxial cable SC so that they are linearly continued, and the groove width possessed by the narrow groove portion 14*a* disposed at the wire connection part, which is the electrical connection region, is formed so as to be smaller than the plate width possessed by the above described insulative pressing plate 11*d* in the electrical connection region.

The regions corresponding to the groove-width-direction both sides of the shell-side recessed groove portion 14 are formed into the cover inner surface of the shell cover portion 13*b*, and the cover inner surface of the shell cover portion 13*b* positioned in both sides of the narrow groove portion 14*a* disposed at the above described wire connection part is formed into drop prevention portions 13*b*6 which abut the upper surface of the insulative pressing plate 11*d* from the upper side. In other words, the droop preventing portions 13*b*6 are in a relation in which the drop prevention portions 13*b*6 abut the upper surface of the insulative pressing plate 11*d*, thereby being stacked above the insulative pressing plate 11*d*; therefore, the insulative pressing plate 11*d* does not enter the interior of the narrow groove portion 14*a*, which is disposed in the electrical connection region of the air layer formed by the shell-side groove portion 14 so that the shell-side recessed groove portion 14 is formed in the electrical connection region.

On the other hand, the groove width of the wide groove portion 14*b* is larger than the plate width of the insulative pressing plate 11*d*; however, the insulative pressing plate 11*d* in the present embodiment is extending only to an intermediate position of the narrow groove portion 14*a* in the extending length direction and is configured not to be opposed to the wide groove portion 14*b*. Therefore, even in the closed state in which the shell cover portion 13*b* of the shield shell 13 is pushed down, the insulative pressing plate 11*d* does not enter the interior of the wide groove portion 14*b*, and the insulative pressing plate 11*d* is retained in a stacked state in which it is in pressure contact with the inner surface of the shell cover portion 13*b* across the entire length thereof. The state in which the shell cover portion 13*b* is stacked above the insulative pressing plate 11*d* is maintained, and the shell-side recessed groove portion 14 is configured to be disposed at the position immediately above the insulative pressing plate 11*d*.

The wide groove portion 14*b*, which forms the other region of the shell-side recessed groove portion 14 somewhat distant from the wire connection part serving as the electrical connection region, is disposed at the position corresponding to the exposed part of the dielectric body SCc of the thin-wire coaxial cable SC as described above, and the groove width possessed by the wide groove portion 14*b* is formed to be somewhat larger than the outer diameter possessed by the dielectric body SCc of the coaxial cable SC. Therefore, the dielectric body SCc of the thin-wire coaxial cable SC is housed in the wide groove portion 14*b* of the shell-side recessed groove portion 14, and the height of the connector is reduced as a result.

The groove width possessed by the wide groove portion 14*b* is set to be larger than the plate width of the insulative pressing plate 11*d* as described above and is set to be larger than the plate width of the internal contact 12 in the electrical connection region. Furthermore, the groove width of the narrow groove portion 14*a* constituting part of the shell-side recessed groove portion 14 as described above is set so as to be the same as or more than the wire diameter of the cable central conductor (signal wire) SCa of the cable-shaped signal transmission medium SC, in other words, the part contacted by the internal conductor contact (signal contact member) 12. Furthermore, the groove width of the narrow groove portion 14*a* constituting the other part of the shell-side recessed groove portion 14 is set to be smaller than the plate width possessed by the upper beam portion 12*a* of the internal conductor contact (signal contact member) 12.

According to the present embodiment having such a configuration, the void portion 11*e* formed by the inner wall surfaces of the through hole provided in the insulative pressing plate 11*d* is disposed in the radial-direction inner region of the external conductor shell 13*a* of the shield shell 13 and is in a disposition relation in which it faces the wire connection part which is the electrical connection region of the cable central conductor (signal wire) SCa and the internal conductor contact 12. Therefore, the air layer for impedance adjustment formed by the void portion 11*e* is disposed so as to face the wire connection part in which mismatching of impedance easily occurs, and the matching degree (VSWR) of impedance which is an important design element of an electric connector is efficiently adjusted; as a result, transmission with good high-frequency signals is easily maintained while downsizing or height reduction of the electric connector is carried out.

Particularly, in the present embodiment, since the void portion 11*e* provided in the insulative pressing plate 11*d* is extending to the region that reaches the bent portion 11*f* of the insulative pressing plate 11*d*, the air layer for impedance adjustment is formed also in the part opposed to the external conductor shell 13*a* of the shield shell 13 in the radial direction. As a result, matching of impedance is further efficiently carried out, and rigidity of the bent portion 11*f* of the insulative pressing plate 11*d* is reduced by the void portion 11*e*. Therefore, a bending operation with respect to the insulative pressing plate 11*d* is easily carried out without causing breakage, etc.

Furthermore, according to the present embodiment, in addition to a matching action of impedance by the void portion 11*e* of the insulative pressing plate 11*d*, matching of impedance is carried out also by the shell-side recessed groove portion 14 provided in the shell cover portion 13*b* of the shield shell 13. Therefore, matching of impedance is further efficiently and easily carried out.

When the void portion 11*e* is formed by a through hole like the present embodiment, since the void portion 11*e* is formed by the through hole which is easy to be manufactured, manufacturing efficiency is correspondingly improved.

Figure 17:
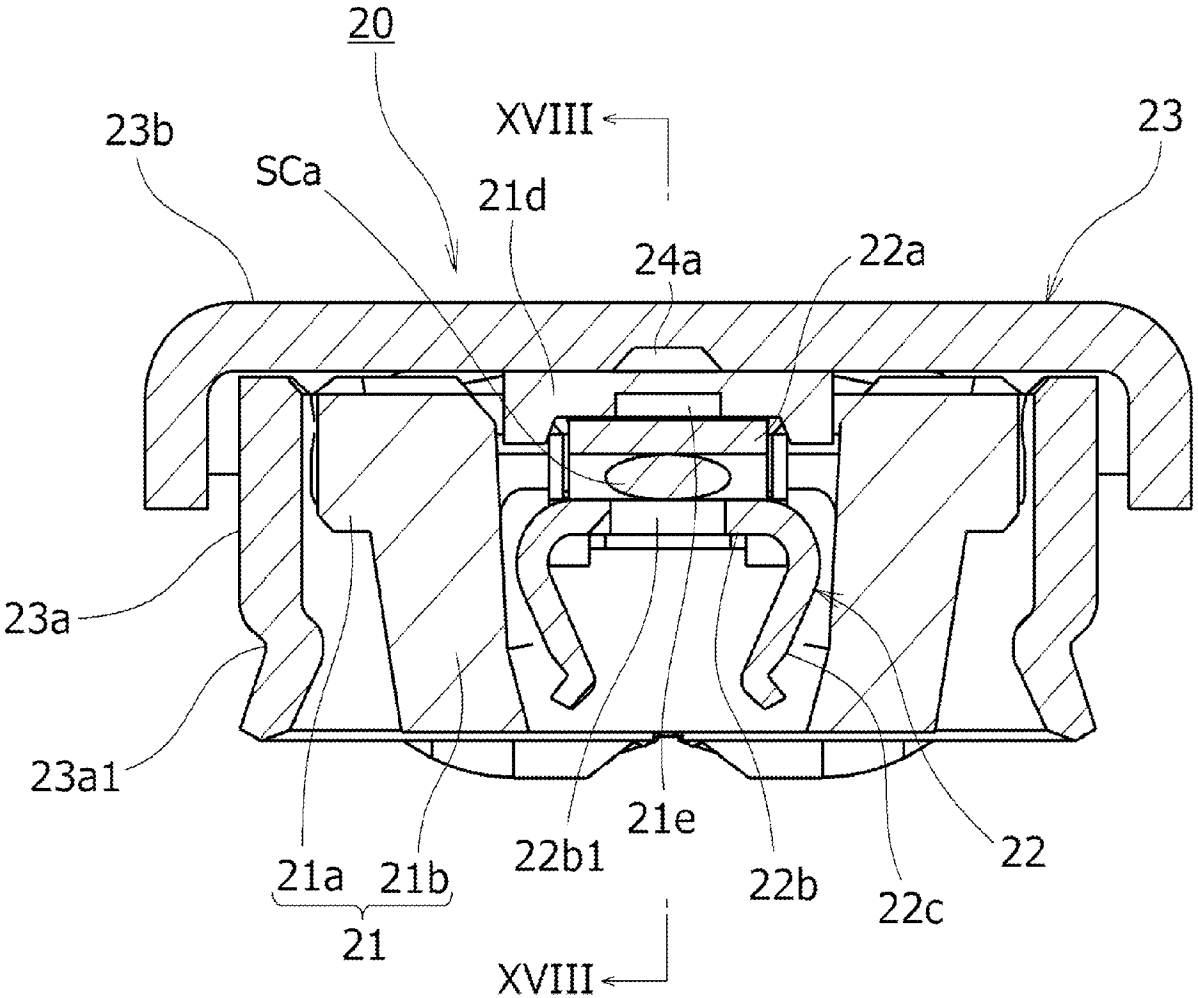
FIG. 17 is an explanatory transverse cross-sectional view showing a configuration of a coaxial-type electric connector (plug connector) according to another embodiment of the present invention and corresponding to FIG. 4.
Figure 18:
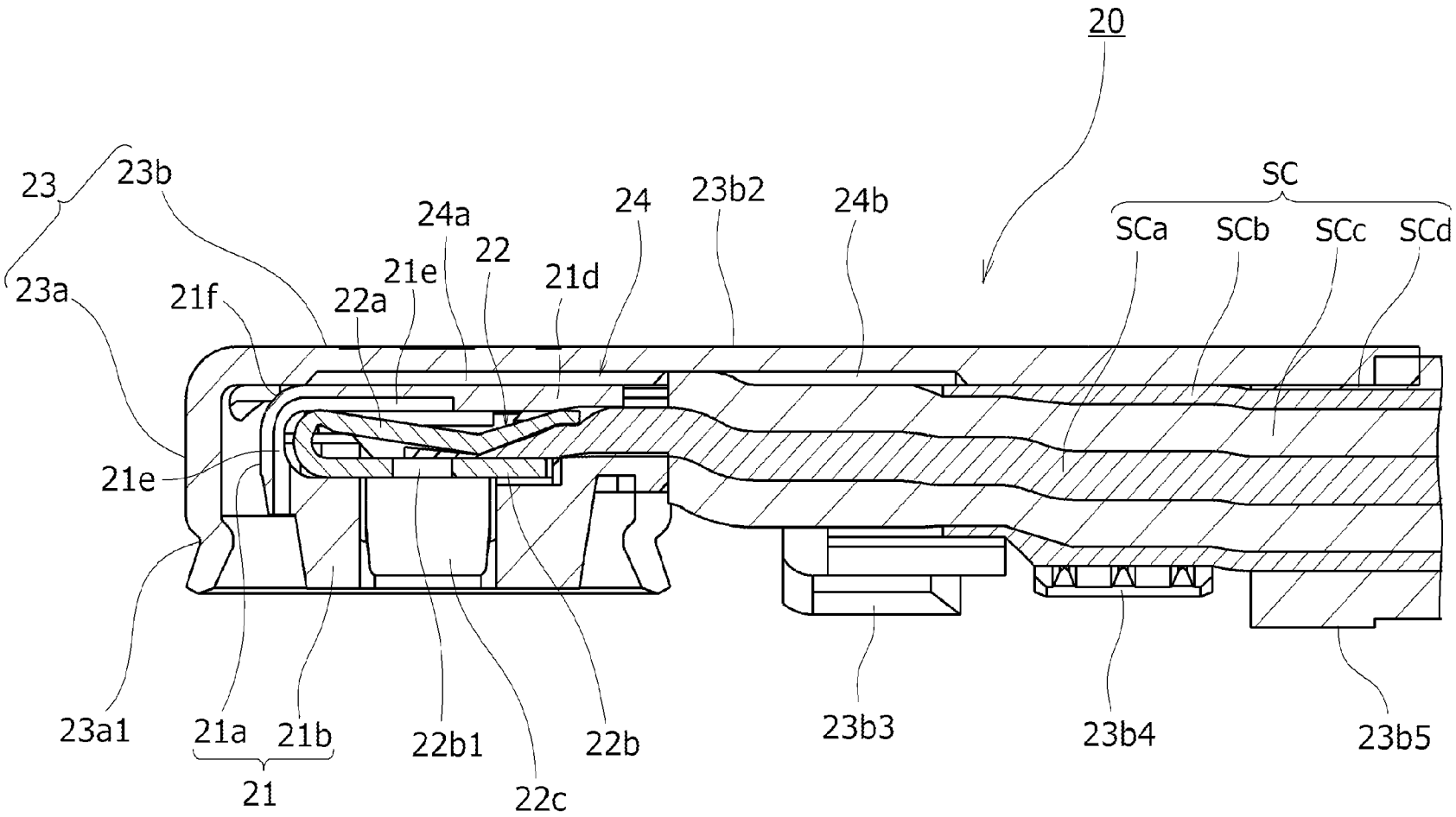
FIG. 18 is an explanatory vertical cross-sectional view taken along a line XVIII-XVIII in FIG. 17.
Figure 19:
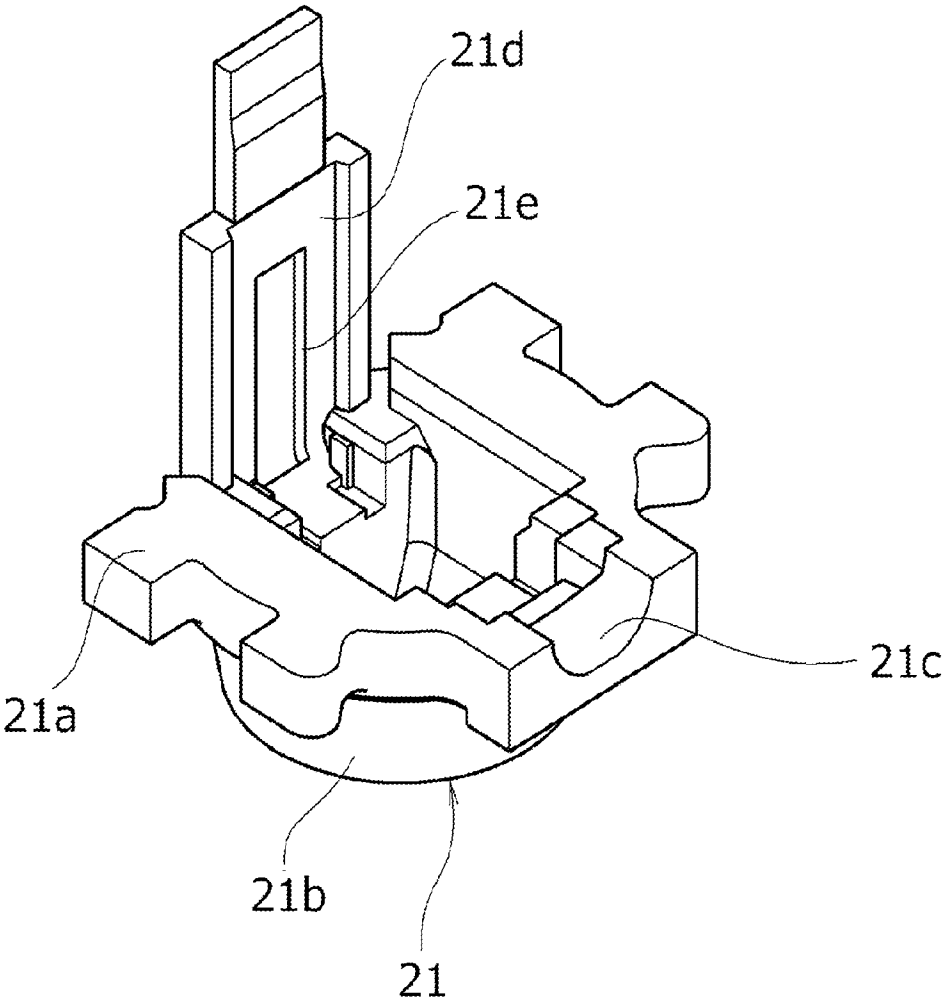
FIG. 19 is an explanatory external perspective view showing an initial open state of a single insulative housing used in the coaxial-type electric connector (plug connector) according to the other embodiment of the present invention.

Next, a configuration of a second embodiment shown in FIG. 17 to FIG. 19 will be explained. In the second embodiment, "1" which is the tenth place of the member reference signs imparted in the above described first embodiment is replaced and expressed by "2". In a plug connector (coaxial-type electric connector) 20 according to the second embodiment, a void portion 21*e* provided in the region in the root base side of an insulative pressing plate 21*d* is formed by a bottomed recessed-shape groove extending in a long and thin shape along the extending direction of the thin-wire coaxial cable SC, and the configurations of the other members are similar to those of the first embodiment.

More specifically, the void portion 21*e* formed by the inner wall surfaces of the bottomed recessed-shape groove according to the present embodiment is also formed so as to be dented to form a step shape in a plate thickness direction (upward direction) on part of the surface of the insulative pressing plate 21*d*; wherein, when the insulative pressing plate 21*d* is disposed so as to be overlapped with the upper side of the thin-wire coaxial cable SC, the recessed-shape groove constituting the void portion 21*e* is in a disposition relation that it faces the "wire connection part" which is the electrical connection region of the cable central conductor (signal wire) SCa and an internal conductor contact 22 from the upper side. The void portion 21*e* consisting of the recessed-shape groove is extending from the "wire connection part (electrical connection region)" of the cable central conductor (signal wire) SCa and the internal conductor contact 22 toward the root base portion side of the insulative pressing plate 21*d* in the connector rear side, is extending so as to be curved along a bent portion 21*f* formed in the insulative pressing plate 21*d*, and is then extending toward the lower side.

Also in the second embodiment provided with the void portion 21*e* consisting of such a bottomed recessed-shape groove, working/effects similar to the first embodiment can be obtained.

Hereinabove, the invention accomplished by the present inventors has been explained in detail based on the embodiments. However, the present embodiment is not limited to the above described embodiments, and it goes without saying that various modifications can be made within the range not departing from the gist thereof.

For example, although the above described embodiments apply the present invention to the electric connectors of a vertical mating type, the present invention can be similarly applied also to electric connectors of a horizontal mating type.

The present invention is not limited to a connector for a single-core thin-wire coaxial cable like the above described embodiments, but can be similarly applied to a connectors for a coaxial cable disposed in a multipolar shape, an electric connector of a type in which a plurality of coaxial cables and insulative cables are mixed, etc.

As described above, the present embodiments can be widely applied to various electric connectors which are used in various electric devices.

What is claimed is:

1. A coaxial-type electric connector having:

an insulative housing to which a terminal part of a cable-shaped signal transmission medium is coupled, an external conductor shell consisting of an approximately hollow cylindrical member attached so as to cover an outer surface of the insulative housing, and an internal conductor contact disposed in a radial-direction inner region of the external conductor shell;

the coaxial-type electric connector configured so that:

a wire connection part of the terminal part of the cable-shaped signal transmission medium and the internal conductor contact is disposed in the radial-direction inner region of the external conductor shell, a shell cover portion that opens/closes an annular opening possessed by the external conductor shell is openably/closably coupled to the annular opening, an insulative pressing plate integrally opened/closed with the shell cover portion is provided at the insulative housing, and, when the shell cover portion is closed so as to cover the annular opening of the external conductor shell and the insulative pressing plate is deformed so as to form a bent portion, pressing force of the insulative pressing plate causes a tongue-shaped portion of the internal conductor contact to contact the cable-shaped signal transmission medium with pressure and form the wire connection part; wherein a void portion formed by an inner wall of a groove dented to form a step shape is provided in part of a surface of the insulative pressing plate and at a position facing the wire connection part of the terminal part of the cable-shaped signal transmission medium and the internal conductor contact;

the void portion is disposed in the radial-direction inner region of the external conductor shell and is formed so that a bore size (W1) in a width direction orthogonal to an extending direction of the cable-shaped signal transmission medium is smaller than an outer-shape size (W2) in the width direction of the tongue-shaped portion of the internal conductor contact.

2. The coaxial-type electric connector according to claim 1, wherein the void portion is provided in a region from the wire connection part to the bent portion so as to extend along the cable-shaped signal transmission medium.

3. The coaxial-type electric connector according to claim 1, wherein the insulative pressing plate is configured to extend along an inner wall surface of the shell cover portion disposed so as to cover the annular opening of the external conductor shell, and a shell-side recessed groove portion disposed to be opposed to the void portion is formed on the inner wall surface of the shell cover portion.

4. The coaxial-type electric connector according to claim 1, wherein the void portion is formed by a through hole.

* * * * *